US005857361A

United States Patent [19]

Jang

[11] Patent Number: 5,857,361

[45] Date of Patent: Jan. 12, 1999

[54] DRUM WASHING MACHINE

[76] Inventor: Sam-Yong Jang, 833-20, Maetan-4-Dong, Paldal-Gu, Suwon-City, Kyungki-Do, Rep. of Korea

[21] Appl. No.: 850,385

[22] Filed: May 2, 1997

[30] Foreign Application Priority Data

May 11, 1996 [KR] Rep. of Korea ..... 1996 15706

[51] Int. Cl.[6] ..... D06F 37/22

[52] U.S. Cl. ..... 68/23.2; 74/573 R

[58] Field of Search ..... 68/23.2; 210/144, 210/363, 364; 73/573 F, 573 R

[56] References Cited

FOREIGN PATENT DOCUMENTS 1 213 067 3/1960 France .

2 393 097 12/1978 France .

*Primary Examiner*—Philip R. Coe

*Attorney, Agent, or Firm*—Burns, Doane, Swecker & Mathis, L.L.P.

[57] ABSTRACT

A balancing device for a drum washing machine is disclosed. The balancing device includes annular-shaped races provided on both sides of the a spin basket, and a plurality of movable bodies seated in the races. A spherical movable body is arranged to contact three inner sides of one race during rotation of the spin basket about a horizontal axis. Either one of the races includes first and second sides spaced apart by a specific axial distance and facing one another, and third and fourth sides spaced radially apart for interconnecting the first and second sides. Either the third side or fourth side of the race is formed at an acute angle relative to the axis, the angle being in the range of 0.5° to 0.85°.

4 Claims, 3 Drawing Sheets

DRUM WASHING MACHINE

BACKGROUND OF THE INVENTION (1) Field of the Invention

The present invention generally relates to a drum washing machine. More particularly, it relates to a balancing device for a drum washing machine realized as annular-shaped races that are provided to both sides of the washing machine's spin basket, and movable bodies seated in each race for the purpose of dynamically counteracting imbalances of the spin basket occurring during washing/dehydrating operation.

(2) Description of the Prior Art

A conventional drum washing machine is an electronic appliance that washes clothes using suds generated by the rotation of its drum-shaped spin basket. In the conventional drum washing machine, washing, rinsing and hydro-extracting tasks are automatically carried out according to a predetermined program. After the washing and rinsing of the clothes are finished, excess water is removed from the clothes by centrifugal force created by the spin basket rotating at high speeds during the dehydrating process. Abnormal vibrations and noise may be produced by the clothes not being evenly arranged in the spin basket during the dehydrating process. Consequently, a balancing device is essential for a drum washing machine to operate properly.

FIG. 3 depicts the construction of a conventional drum washing machine.

Referring to FIG. 3, the drum washing machine includes a housing 1, a tub 2 suspended by suspension springs 4*a* and shock-absorbing members 4*b* in the housing 1, and a spin basket 3 rotatably installed in the tub 2. The spin basket 3, which is rotated by an electric motor 5 installed on the bottom of the housing 1, includes a plurality of small holes 3*a* formed on all of its surfaces, and a plurality of lifters 3*b* protruded inward.

Water that is removed from clothes in the spin basket 3 by centrifugal force flows into the tub 2 through these small holes 3*a,* and lifters 3*b* raise the laundry and water to a constant height when the spin basket 3 rotates. In order to prevent the generation of vibrations during the washing/dehydrating process, counterweights 6*a*,6*b*, each of predetermined weight, are attached to the tub 2. The front counterweight 6*a* is provided to the front of the tub 2, and the upper counterweight 6*b* is mounted on the top surface of the tub 2. The front counterweight 6*a* is 11.4 kg, and the upper counterweight 6*b* is 12.2 kg. These counterweights 6*a* and 6*b* are made from cast iron and are joined to the tub 2 by bolts 7.

Such a conventional balancing device does not prevent production of the vibrations by laundry that is not evenly distributed in the washing machine, but rather only dampens the vibrations with the counterweights attached, thus having inferior balancing characteristics. Moreover, the conventional balancing device dampens the vibrations after they have already been transmitted to the tub, and is therefore incapable of controlling an imbalance at an early stage.

SUMMARY OF THE INVENTION

The present invention concerns a balancing device for a drum washing machine that can obviate the above-described problems and disadvantages of the conventional art.

It is an objective of the present invention to provide a balancing device for a drum washing machine which can dynamically counteract imbalances which are created by the uneven distribution of laundry in the washing machine's spin basket during rotation.

It is another objective of the present invention to provide a balancing device for a drum washing machine in which movable bodies move concentrically within a race without radially shaking, thereby assuring quick counterbalancing.

In order to obtain the aforementioned objectives of the present invention, there is disclosed a balancing device for a drum washing machine that includes: a tub; a spin basket formed in the tub to be rotatable about a horizontally-supported shaft; a race formed in the spin basket to be concentric with the spin basket; and a plurality of movable bodies seated in the respective race, each in contact with three inner sides of the race. The race includes a first side radially spaced apart and a second side spaced a specific axial distance away from one another to face each other, and a third side and a fourth side each interconnecting the first and second sides. Either the third or fourth side of the race may extend at an acute angle relative to the axis, and each of the movable bodies is spherical in shape and designed to move in the race contacting either the first or second side, and both the third and fourth sides. Alternatively, both the third and fourth sides of the race may be formed on an angle. It is preferable that the angle of inclination by the third and fourth sides is in the range of 0.5° to 0.85°.

DETAILED DESCRIPTION OF THE PREFERRED EMBODIMENTS

The preferred embodiments of the present invention will be now described in detail with reference to the accompanying drawings.

Figure 1:
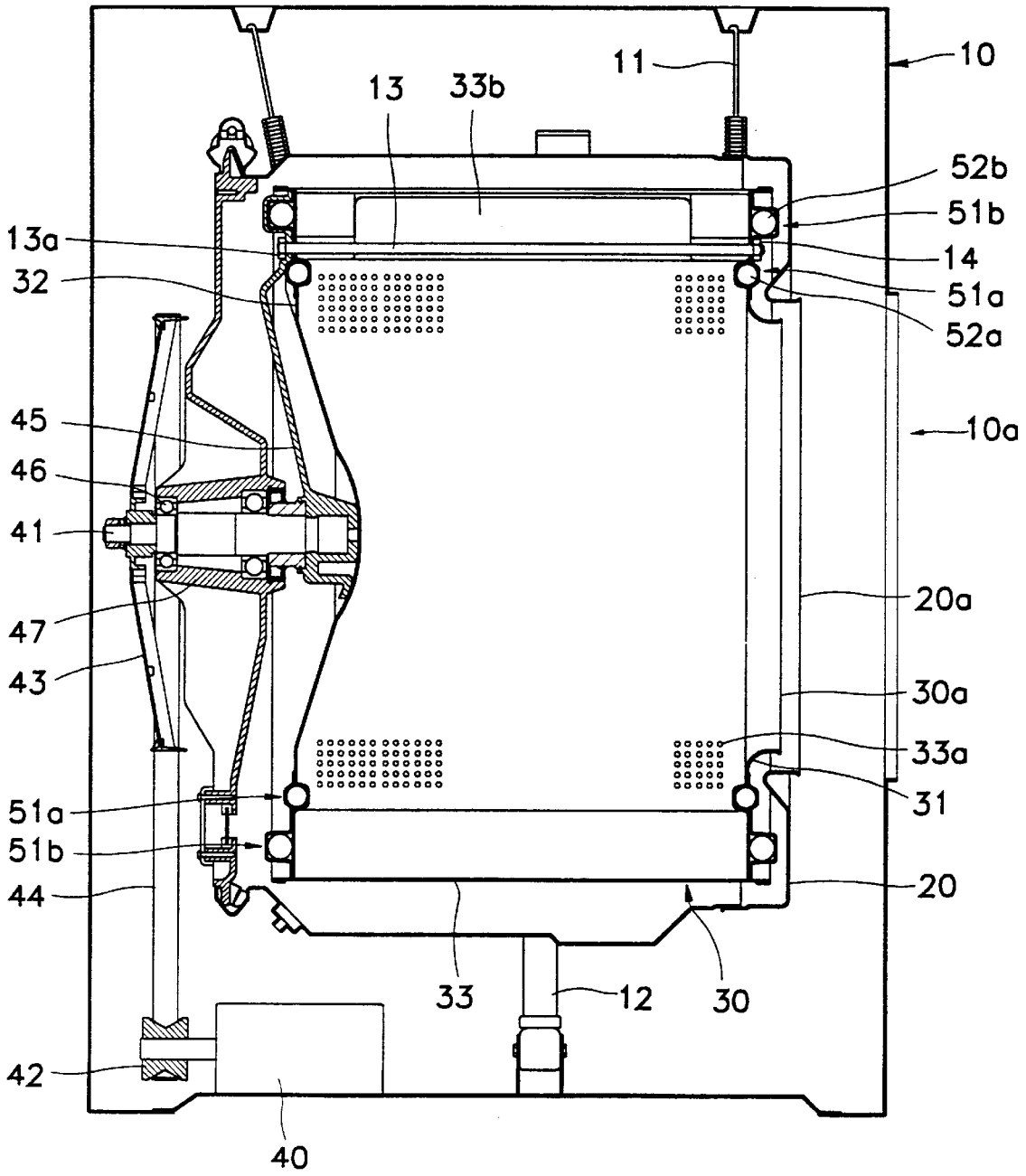
FIG. 1 depicts the overall construction of a drum washing machine with a balancing device in accordance with the present invention.

FIG. 1 is a sectional view showing the overall construction of a drum washing machine equipped with a balancing device in accordance with the present invention.

As shown in FIG. 1, the drum washing machine includes a housing 10, a tub 20 suspended in the housing 10, a spin basket 30 rotatably installed within the tub 20, and an electric motor 40 mounted below the tub 20 to rotate the spin basket 30. The tub 20 is suspended of four springs 11 arranged on four sides in the housing 10, and a pair of shock absorbing members 12 are provided under the tub 20. The tub 20 and spin basket 30 are installed parallel to the ground rather than upright, and openings 10*a,* 20*a* and 30*a* are formed on the front of the housing 10, a predetermined spot of the tub 20 corresponding to the front of the housing 10, and a corresponding spot of the spin basket 30, respectively, so that laundry can be put into or taken out of the spin basket 30 therethrough.

The spin basket 30, consists of a cylindrically-shaped side panel 33 with front and rear panels 31 and 32 respectively joined to its front and back. A plurality of holes 33*a* are uniformly distributed in the side panel 33, and a plurality of lifters 33*b*, which raise and drop laundry during washing, are formed on the side panel 33 protruding inward in the form of a "V", each spaced 120° from the others. The small holes 33*a* allow water to flow freely between the tub 20 and the spin basket 30, and allows water to flow into the tub 20 from laundry during the dehydrating process.

The rotating force of the electric motor 40 is transmitted to the spin basket 30 through the rear panel 32, which is connected to one end of a horizontally supported shaft 41. The shaft 41 extends to the rear of the tub 20. A first pulley 42 is connected to the electric motor 40, and a second pulley 43 is connected to the shaft 41. A belt 44 is placed between the first and second pulleys 42 and 43, and a flange 45 is provided to the rear panel 32 connected with the shaft 41. A pair of bearings 46 are installed in a bearing housing 41 between the shaft 41 and the tub 20 so as to support the shaft 41.

The spin basket 30 has a pair of balancing devices provided to both the front and rear panels 31 and 32 so as to remove the vibrations and imbalances created during rotation. The balancing devices are realized as annular races 51*a* and 51*b* that are coaxially formed on the inner and outer sides of the front and rear panels 31 and 32, respectively, and spherical movable bodies (hereinafter, "balls") 52*a* and 52*b* that are seated in the races 51*a* and 51*b*, respectively. As described above, the races 51*a* and 51*b* are placed on the inner and outer sides of the front and rear panels 31 and 32, and the inner race 51*a* and the outer race 51*b* protrude inward and outward, respectively. The inner race 51*a* and the outer race 51*b* are fitted to each other by welding to form a seal.

The races 51*a* and 51*b* contain a predetermined amount of oil to allow the balls 52*a* and 52*b* to move freely. Steel balls are used as the movable bodies 52*a* and 52*b*.

The balancing device of the present invention will be more fully described as follows.

Because the races 51*a* and 51*b*, provided to the front panel 31 and rear panel 32, have essentially the same structure, only the structure of the races 51*a* and 51*b* on the front panel 31 will be described in detail.

Figure 2:
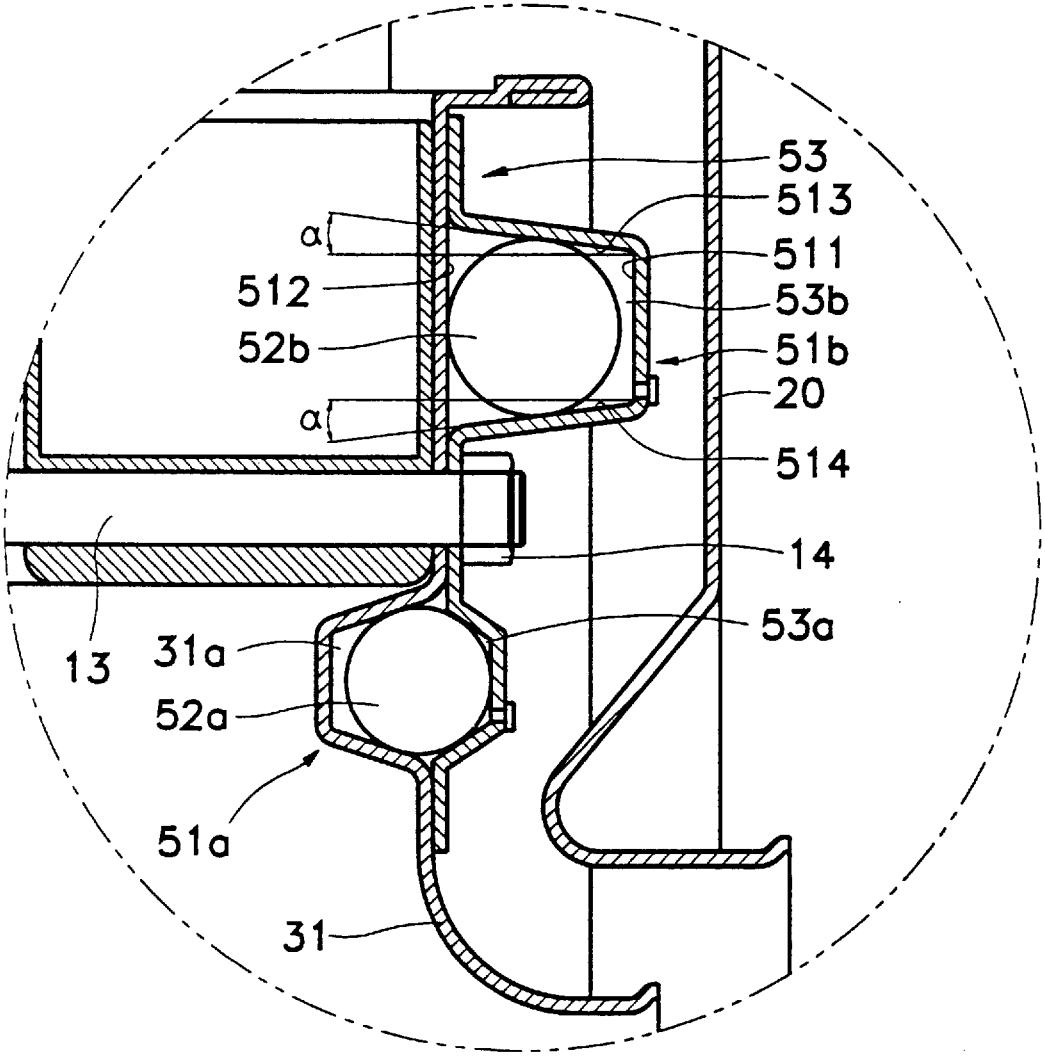
FIG. 2 is a partially enlarged view of the balancing device of FIG. 1.
Figure 3:
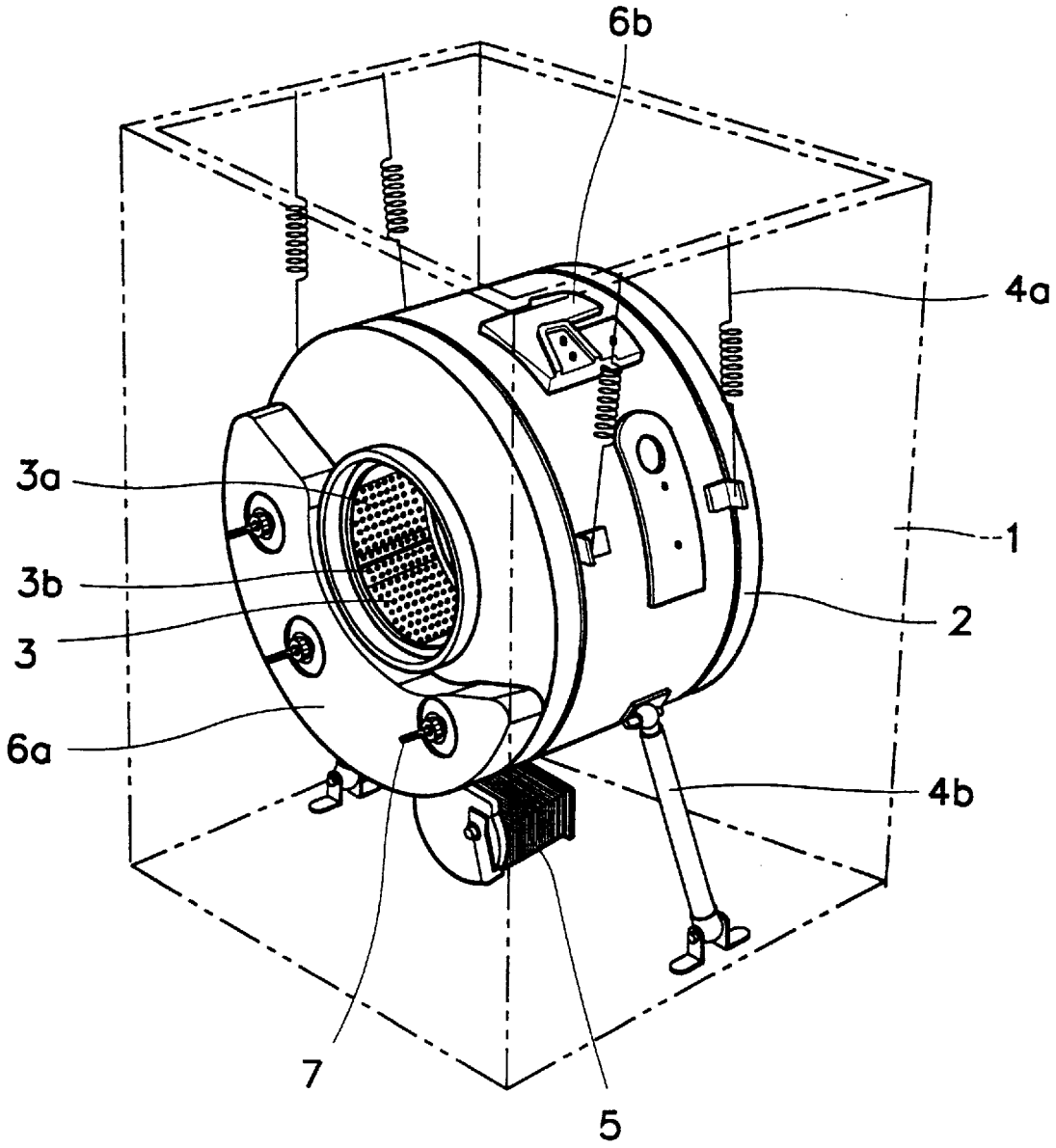
FIG. 3 (Prior Art)
FIG. 3 depicts the overall construction of a drum washing machine with a conventional balancing device.

As shown in FIG. 2, the races 51*a* and 51*b* are constituted of the combination of the front panel 31 and a cover 53 coupled to the front panel 31. The outer race 51*b* is formed of the combination of a flat portion of the front panel 31 and a groove 53*b* in the cover 53, while the inner race 51*a* is formed of the combination of a first groove 31*a* in the front panel 31 and a second groove 53*a* in the cover 53. The race 51*b* is of annular shape includes a first side 511 and a second side 512 that faces the first side 511, and a third side 513 and a fourth side 514, each connecting the first side 511 with the second side 512 (referring to FIG. 2, the first side 511, second side 512, third side 513, and fourth side 514 are on the right, left, top and bottom, respectively). The third and fourth sides 513 and 514 are angled outwardly towards each other, and the balls 52*b* are situated and sized to contact the second, third and fourth sides 512, 513 and 514 of the race 51*b* as they move. The angled third and fourth sides 513 and 514 of the race 51*b* prevent the balls 52*b* from shaking radially as they move along the circumference of the spin basket 30 in the race 51*b*. Alternatively, only one of the third and fourth sides 513 and 514 could be angled, and the third or fourth sides 513 and 514 may taper to the left so that the balls 52*b* contact the first side 511, third side 513 and fourth side 514. The acute angle of inclination $\alpha$ of the third and fourth sides 513 and 514 relative to a line parallel to the axis of rotation is less than 0.85° irrespective of the diameter of each of the balls 52*b*, and it is preferable that the angle $\alpha$ is in the range of 0.5° to 0.85°. There is no strict limit to the angle $\alpha$, however it is in the range of 0.5° to 0.85° in consideration of the fabrication of the metal mold for the race 51*b*.

As shown in FIGS. 1 and 2, the cover 53 and the front and rear panels 31 and 32 are fastened together by a bolt 13, thus providing a sound basket structure. The bolt 13 fastens onto a nut 14 at the front panel 31, passing through the space between the races 51*a* and 51*b*, and a bolt head 13*a* adheres to the outside of the balancing device at the rear.

The following description relates to the operation of the balancing device in accordance with the present invention.

Garments to be washed are positioned on the bottom of the spin basket 30. If the garments become unevenly distributed as the spin basket 30 rotates at high speeds, the balls 52*a* and 52*b* move along the races 51*a* and 51*b* to the opposite side of the spin basket 30 as the bulk of the clothes by centrifugal force generated by the high-speed rotation of the spin basket 30, thereby compensating for the imbalance and preventing the vibration and eccentric rotation of the spin basket 30.

More specifically, the spin basket 30 rotates eccentric from its geometric center due to the laundry being gathered on one spot in the spin basket 30. The centrifugal force from the geometric center and that of its center of rotation simultaneously act on the balls 52*a* and 52*b*, placed in the races 51*a* and 51*b*, so that the balls 52*a* and 52*b* relocate to a predetermined position to oppose the imbalance. The balls 52*a* and 52*b* turn about the geometric center of the spin basket 30, thus making the spin basket 30's center of rotation meet the geometric center. The unbalanced state of the spin basket 30 is then countered to thereby eliminate the vibration and noise. Since the balls 52*b* move within the race 51*b* contacting the second, third and fourth sides 512, 513 and 514 all the time, they form concentric circles during movement, preventing the noise and the delay of movement. The oil contained in the races 51*a* and 51*b* allows the balls 52*a* and 52*b* to move along the races 51*a* and 51*b* smoothly.

As described above, the drum washing machine, equipped with the balancing device of the present invention, prevents the spin basket from rotating abnormally by countering its unbalanced state due to the laundry not being evenly distributed therein, and eliminates the vibration and noise during rotation. Further, the inventive balancing device can prevent unnecessary wear of the components used to support the rotation of the spin basket and abnormal noise created by friction. Furthermore, the balls seated in the race move in the races contacting the three sides of the race all the time, so they do not flow randomly but move concentrically. This construction prevents the balls from being delayed, and makes them move fast, thereby offering the prompt and superior counterbalancing action. In addition, since two sides of the race are formed on an angle, it is easy to take the race out of a metal mold in the molding process.

What is claimed is:

1. A drum washing machine comprising:

a tub;

a spin basket mounted in the tub to be rotatable about an axis defined by a horizontally-supported shaft;

a race formed on the spin basket to be concentric with the spin basket; and a plurality of movable bodies seated in the race, the bodies contacting at least three inner sides of the race;

wherein the race includes first and second sides spaced apart by an axial distance and facing one another, and third and fourth sides spaced apart radially from each other for interconnecting the first and second sides, at least one of the third and fourth sides extending at an acute angle relative to the axis, and each of the movable bodies being spherical in shape and sized to move in the race while contacting only one of the first and second sides, and both of the third and fourth sides.

2. The drum washing machine as set forth in claim 1, wherein each of the third and fourth sides of the race extends at an acute angle relative to the axis.

3. The drum washing machine as set forth in claim 2 wherein the acute angle is in the range of 0.5° to 0.85°.

4. The drum washing machine as set forth in claim 1 wherein the acute angle is in the range of 0.5° to 0.85°.

* * * * *